US005449579A

United States Patent [19]

Tarutani et al.

[11] Patent Number: 5,449,579

[45] Date of Patent: Sep. 12, 1995

[54] COLORED METAL PLATE AND PROCESS FOR MANUFACTURING SAME

[75] Inventors: Yoshio Tarutani; Hajime Murakami, both of Kusatu, Japan

[73] Assignee: Ishihara Sangyo Kaisha Ltd., Osaka, Japan

[21] Appl. No.: 324,531

[22] Filed: Oct. 18, 1994

Related U.S. Application Data

[63] Continuation of Ser. No. 461,905, Jan. 8, 1990, abandoned.

[30] Foreign Application Priority Data

Jan. 10, 1989 [JP] Japan ..... 1-2000

[51] Int. Cl.[6] ..... G03G 13/00

[52] U.S. Cl. ..... 430/31; 430/42; 430/45

[58] Field of Search ..... 430/31, 42, 45, 55

[56] References Cited

U.S. PATENT DOCUMENTS 4,789,612 12/1988 Haneda et al. ..... 430/42
4,943,506 7/1990 Demizu et al. ..... 430/110

FOREIGN PATENT DOCUMENTS 48-094439 12/1973 Japan .
48-094440 12/1973 Japan .
49-22944 2/1974 Japan .
50-090332 7/1975 Japan .
50-141326 11/1975 Japan .
58-040177 9/1983 Japan .
58-040178 9/1983 Japan .
59-019329 5/1984 Japan .
59-019330 5/1984 Japan .
60-0007781 2/1985 Japan .
60-007782 2/1985 Japan .

*Primary Examiner*—S. Rosasco
*Attorney, Agent, or Firm*—Browdy and Neimark

[57] ABSTRACT

The invention or the instant application relates to a process for manufacturing a colored metal plate, in that forming an electrophotosensitive layer mainly composed of titanium dioxide and a binder resin on a metal plate as a raw material having a smooth surface of 2 μm Ra or less in the center line average height, and then forming an toner image having a surface granularity of 0.3 or less on the photosensitive layer by electrophotographic method.

20 Claims, No Drawings

COLORED METAL PLATE AND PROCESS FOR MANUFACTURING SAME

This application is a continuation of application Ser. No. 07/461,905, filed Jan. 8, 1990, now abandoned.

FIELD OF THE INVENTION

The technique disclosed herein belongs to a technical field concerning a process for manufacturing a colored metal plate, such as steel plate, and a process for manufacturing the same.

BACKGROUND OF THE INVENTION

As is well known, a metal plate, e.g., a stainless steel plate, is generaly widely used as a building material etc. by virtue of its beautiful metallic surface gloss and excellent corrosion resistance. However, even SUS 304 steel believed to have sufficient corrosion resistance when used as the commonest general-purpose steel plate often brings about red rust with time when used in an exposed state for armoring not only in a region where many salt particles come flying from the seek, e.g., near the shoreline, but also in ordinary towns.

The above-described occurrence of rust is mainly due to the "catching rust" accompanying the deposition of floating dust, particularly fine iron powder in the air. This remarkably spoils the image of a high-grade product, i.e., "stainless=free from rust". Thus, an improvement in this respect is one of the big subjects for research in the art even in these days.

A coated stainless steel plate has been developed and commercialized for the purpose of solving the above problems and, at the same time, imparting a decorativeness to attain an attractive appearance as a building material.

Coated stainless steel plate which have been commercialized in these days are classified into those coated with silicone polyester-based resin, fluororesin, acrylic resin, etc. according to the kinds of organic resin paints to be applied on the steel plates. They have been used according to the purposes of use and the performance requirements. Specifically, the steel plates coated with silicone polyester based resin, fluororesin and acrylic resin have been used as a general-purpose opaque resin-coated stainless steel plate, a long-term weather-resistant high-quality coated stainless steel plate and a general-purpose transparent resin-coated stainless steel plate, respectively.

However, these coated stainless steel plates are basically limited to plain-color coating, and the number of colors easily available is limited to several colors called standard colors.

Accordingly, the reason why metal plates, such as stainless steel, having various hues have not been commercialized up to now in spite of their potential needs resides in (1) the restriction derived from the use of a mass production type large-scale high-speed coating line of the roll coat type in the manufacture of a coated stainless steel plate and (2) a disadvantage that in the production of a coated stainless steel plate having a special color other than several kinds of limited colors called standard colors, a mass-production effect is remarkably spoiled due to necessity of manufacture in a small lot, which unfavorably brings about an increase in the production cost.

Further, when a color other than the standard colors is desired, a paint for the special color should be separately purchased from a paint manufacture, which often brings about problems of reproducibility of color in combination with fading of the color caused by ultraviolet rays and needs a long time for the delivery of the paint.

Further, one of the ever-increasing demands in recent years from users for metal plates, such as surface treated stainless steel plates, is to enhance the decorativeness of metal plates such as surface treated stainless steel plates.

The demand for the enhancement of the decorativeness results from the progress of the enhancement of the decorativeness of the interior of the building accompanying an improvement in the level of the civic life in recent years and an ever-increasing demand for individualization, and the conventional coating method of the above-described roll coat type cannot cope with these demands from users unfavorably.

A coated steel plate including the so-called "colored galvanized steel sheet" which uses a plated steel plate as the base plate also brings about the same problem as that of the above-described coated stainless steel plate.

Specifically, although the history of the coated steel plate which uses a plated steel plate as the base plate is longer than that of the coated stainless steel plate and has been more diversified also from the viewpoint of the coating technique, the needs of the users are more and more specialized and complicated.

One of the fields of products having the strongest tendency towards an enhanced decorativeness is that of outer casings of domestic electric appliances. In this field, ultrahigh-quality domestic electric appliances of made-to-order type have come to be manufactured in recent years, which expedites further individualization of such domestic electric appliances.

This means that the production in a small lot and individualized outer casing are necessary. Therefore, manufacturers of coated metal plate are required to develop a manufacturing technique capable of coping with the above-described demands.

Examples of the existing process for manufacturing a colored steel plate include a process for manufacturing a steel plate having a high decorativeness which comprises laminating a printed vinyl chloride resin or fluororesin film on a steel plate as a raw material. However, the printing on this kind of film is basically conducted according to a coloring method suited for mass production, such as the above-described roll coat method, which puts various restrictions on the colored steel plates, so that it is difficult to cope with the individualization encountered in, e.g., the field of ultrahigh quality domestic electric appliances.

Even if a printing method in the sheet form is adopted to cope with the individualization, it is apparent that the cost is unfavorably increased.

Offset printing, silk printing, etc. adopted for cans for beverages made of a tin plate or the so=called "tin-free steel" are very attractive as a method of attaining an enhanced decorativeness. However, in this method, it is necessary to prepare as many expensive printing plates as the number of the colors, which brings about an increase in the cost. Further, during printing, the metal plate should be passed through as many high speed printing machines as the number of the colors and further passed through a large-scale baking oven. Therefore, it is impossible to sufficiently cope with a demand for various kinds of products in small lots.

The conventional coloring technique for the metal plate has been developed for products having a relatively small printing area, such as cans for beverage, and are not always technically suitable for the field where it is necessary to color a building material having a large area, such as wall material.

Further, in special cases, coloring of a stainless steel plate through optical interference of a composite thin film of chromium hydroxide and chromium oxide formed by the so-called "anodic oxidation" including the Inco process which has come to be used mainly for interior ornamentation of, e.g., the wall of an underground street and interior and exterior ornamentation of high-rise buildings in the late several years is attractive from the viewpoint of hue. However, in this method, coloring is basically conducted by immersing a metal plate in a colorant solution, and in order to form a pattern it is necessary to provide very complicated steps, such as a step of masking the metal plate as the raw material for immersion or a step of removing specified colored portions through partial grinding after coloring, so that it is necessary to solve various problems of restrictions and requirements when mass production on a commercial scale is intended.

Further, in order to conduct coloring through optical interference, the color should be controlled by varying the thickness of the thin film. In this case, it is necessary to read the immersion time or a small change in the spontaneous immersion potential, which unfavorably makes it difficult to finely adjust the difference in the color between lots.

SUMMARY OF THE INVENTION

An object of the present invention is to provide, without sticking to the conventional steel plate coloring method, an excellent colored metal plate and a process for manufacturing the same which can be applied to the coloring of various metal plates having a high decorativeness in small lots and which are useful in the field of application in various industries where coloring technique is utilized, through elimination of the problems of the coloring method of a metal plate of the above-described prior art which have been found as a result of various studies on a metal plate-coloring method capable of meeting user's demand for the enhanced decorativeness, individualization and higher-grade products, i.e., problems that the conventional coating method as the metal plate coloring method and the coloring method based on the optical interference of a thin film are both disadvantageous as the coloring method for various kinds of metal plates having a high decorativeness with a plurality of colors, i.e., various coating methods based on the roll coat method among various coating methods are suitable for coating with a plain color or mass-production of a metal plate, such as a steel plate having a simple pattern, but unsuitable for various kinds of colored metal plates in small lots and printing of a fine pattern or a photograph, problems that although, in the metal printing method, it is possible to prepare a colored plate having a pattern to some extent and print a photograph when the number of repetitions of printing is increased, it is necessary to prepare as many expensive printing plates as the number of necessary colors, so that this method is unsuitable for various kinds of products in small lots although it is more suitable than the roll coat method, and problems that the method of coloring based on optical interference is disadvantageous in provision of a pattern, fine control of color and reproducibility of color and resistance to fingerprints.

The gist of the present invention is as described in the claims of the instant application, and in order to solve the above-described problems and attain the above-described object, the present invention relates to:

1) a process for manufacturing a colored metal plate, which comprises, after the formation of an electrophotosensitive layer mainly composed of titanium dioxide and a binder resin on a metal plate as a raw material having a smooth surface of 2 μm Ra or less in the center line average height, developing the surface of the electrophotosensitive layer by (a) charging the surface of the electrophotosensitive layer and then developing the charged surface with a developer, (b) charging the surface of the electrophotosensitive layer, exposing the charged surface and then developing the exposed surface with a developer, or (c) applying an electric potential having the same polarity as that of the particle of a developer to a developing electrode opposed to the surface of the electrophotosensitive layer;

(2) a process for manufacturing a colored metal plate according to claim 1, wherein a multicolored image is formed through the use of a developer for a plurality of colors by successively repeating the following procedures (a), (b) or (c): (a) charging the surface of the electrophotosensitive layer and then developing the charged surface with the developer, (b) charging the surface of the electrophotosensitive layer, exposing the charged surface and then developing the exposed surface with the developer, or (C) applying an electric potential having the same polarity as that of the particle of the developer to a developing electrode opposed to the surface of the electrophtosensitive layer;

(3) a process for manufacturing a colored metal plate according to any one of the antecedent (1) and (2), wherein said developer is at least one member selected from among a cyan developer, a magenta developer, a yellow developer and a black developer;

(4) a colored metal plate comprising a metal plate as a raw material having a smooth surface of 2 μm Ra or less in the center line average height, an electrophotosensitive layer mainly composed of titanium dioxide and a binder resin and provided on said metal plate, and an image composed of the particles of a developer and formed on the surface of said electrophotosensitive layer; and (5) a colored metal plate according to the antecedent (4), which further comprises a transparent resin coating layer or a transparent resin film layer provided on the surface of the developing layer on the electrophotosensitive layer.

The present inventors have made various studies on the application of electrophotography to a technique for coloring a steel plate and, as a result, have found that the electrophotography wherein the electrophotosensitive layer is mainly composed of titanium dioxide having an excellent hiding power and a binder resin and its application are effective as a technique for coloring a metal plate, applicable to both the coloring of a metal plate, such as a steel plate, and the production in small lots of various kinds of colored metal plates having a high decorativeness with a plurality of colors. The present invention has been completed based on this finding.

The reason why the present inventors have noted the electrophotography and its application for coloring a metal plate, such as a steel plate, is that since the site and amount of deposition of a charge-detecting color pigment can be basically controlled electrically by taking advantage of photoconductivity, the electrophotography has the following advantages:

(1) it is excellent in the color control;

(2) it is excellent in the reproducibility of coloring of fine pattern, a photograph, etc. on a metal plate such as a steel plate;

(3) it is excellent in the productivity in a small lot comprising several sheets;

(4) it is possible to attain reproduction of a full-range color by using charge-detecting color pigments for three colors of yellow, magenta and cyan or if necessary four colors of the above colors and black;

(5) a printing plate and surface working of a coating roll are unnecessary; and (6) production of a short delivery time is possible.

The technical level of the prior art will now be briefly described, and at the same time the difference between the prior art and the invention of the instant application will be described.

Examples of the prior art comprising the application of electrophotography to a steel plate include inventions disclosed in Japanese Patent Laid-Open Nos. 98439/1973, 94440/1973, 22944/1974, 90332/1975, and 141326/1975. Among them, the invention disclosed in Japanese Patent Laid-Open No. 94440/1973 relates to a technique for the formation of a coloring paint through blending of a wash primer, an epoxy resin paint or a urethane-based paint with a photoconductive powder and further discloses a technique wherein the photoconductive powder includes zinc oxide and titanium oxide which is used also in the present invention of the instant application.

However, all the methods disclosed in the above-described patent laid-open specifications each basically comprise further spreading a photoconductive powder on a coating layer and simultaneously charging the coating film and the photoconductive powder spread on the coating film, thereby depositing the photoconductive powder on the surface of the coating film.

Further, the above-described inventions each relate to a method wherein an image is formed by optically projecting an intended image to eliminate electric charges of the photoreceptor portion and scattering only those powders which are present in the portions where electric charges have been eliminated. Therefore, these methods are utterly different from the method of the present invention which comprises charging the surface of an electrophotosensitive layer and then subjecting the charged electrophotosensitive layer to development and coloring in a solution of a charge-detecting colorant.

Examples of the prior art disclosing a photosensitive material mainly composed of titanium dioxide and a binder resin and electrophotography which uses the photosensitive material as the electrophotosensitive layer includes besides the above-described inventions, inventions accomplished by one of the present inventors (Japanese Patent Publication Nos. 40177/1983, 40178/1983, 19329/1984, 19330/1984, 7781/1985, and 7782/1985). In these inventions, the applicant discloses an example of the conductive substance as a base material suitable for the application of a photosensitive material mainly composed of titanium oxide and a binder resin and describes that paper and cloth having a conductive material applied thereon, a plastic sheet having a "metal" evaporated thereon, paper having a metallic foil laminated thereon a "metallic sheet" etc may be used The present inventors have studied the application to a metallic sheet in the above-described material and the application of a colored sheet as an alternative to the conventional coated steel plate and, as a result, have found that there arises many problems when the application is specifically considered, The present invention has been completed by overcoming these various problems, These various problems will now be clarified, and the invention of the instant application will be described in more detail.

A photosensitive titanium dioxide layer having photoconductivity is formed by coating a specified metal plate, such as a steel plate, with a coating solution prepared by making use of a resin as a binding agent and properly adjusting the viscosity with a solvent, and baking the coating to have a predetermined thickness. A local variation in the thickness of the photosensitive layer affects the so-called "electrophotographic characteristics", such as electrification and photosensitivity, and causes the hue to be varied in the portions different from each other in the thickness, which spoils the uniformity. Consequently, the finishing of images Which require uniformity, e.g., sky, cloud, wall or the face of a person, are harsh to the appearance. In order to avoid this phenomenon, it is desirable that the steel plate as a support for the photosensitive layer be smooth in the surface, small in the variation in the in-plane plate thickness, and free from warping like paper or a plastic film. However, the metal plate, such as the rolled plate, which has been actually manufactured is not so smooth as a plastic film except for one subjected to the so-called "bright finishing". Furthermore, the variation in the plate thickness in the thicknesswise direction unavoidable in the rolling step of the conventional plate manufacturing technique, warping observed when a metal plate produced through winding in a coil form is unwound, and a lowering in the flatness due to the so-called "edge elongation", "center elongation" and "corrugated elongation" in the widthwise direction of the plate are unavoidable problems inherent in the metal plate, such as a steel plate having rigidity.

The present inventors have studied on the shape of a metal plate capable of solving the above-described problems under various conditions for coating a photosensitive layer and, as a result, have found that when the center line average height of the metal plate, such as a steel plate, is 2 $\mu$m Ra or less, it is possible to apply a photosensitive layer capable of forming an excellent image without bringing about any conspicuous harshness (granularity) of the surface of the photosensitive layer and that with regard to an allowable lowering in the flatness caused by the warping, corrugated elongation, center elongation and edge elongation of the metal plate, theoretical analysis and experiment wherein the steel plate is put on a surface plate to measure the height have revealed that the height should not exceed 10 mm, preferably should be 5 mm or less in the major portion thereof, most preferably should be 3 mm or less.

It has also been found that since oleaginous matter, such as rolling oil, deposited on a metal plate remarkably deteriorates the coating adhesion of the photosensitive layer, the metal plate as a raw material should be sufficiently degreased and that, after degreasing with an organic solvent, it is preferred to conduct immersion degreasing or electrolytic degreasing in an alkaline solution, or electrolysis in an acid solution, pickling, etc. which serves also as a pretreatment of the coating.

Examples of the metal plate include stainless steel plate, plated stainless steel, high alloy steel plate, chromium steel plate, titanium plate, aluminum plate, copper plate, and clad plate thereof. The surface may be either treated or untreated. It is preferred that the metal plate used as the raw material plate be inherently excellent in the corrosion resistance, because no effect of improvement in the corrosion resistance can be expected through coating of these plates as opposed to the conventional coated steel plate.

Suitable examples of the stainless steel plate include those which are inexpensive, versatile and sufficiently corrosion-resistant, e.g., ferrite-based stainless steels such as SUS430, SUS434 and SUS43OLX and austenitic stainless steels such as SUS304 and SUS316.

It is needless to say that there is no need for the metal plate to be standard steel etc.

The plated metal plate may be any one of the metal plates having a surface roughness of 2 μm Ra or less in terms of the center line average height, such as tin plates, galvanized steel plates, aluminum-plated steel plates and alloy-plated steel such as tin-free steel.

Examples of the high alloy metal plate include a nickel-based High alloy metal.

Examples of the chromium-based steel plate include a chromium steel plate containing 12% or less of chromium which fails to meet the conventional standard requirements of stainless steel plate but brings about no problem of corrosion in some applications, e.g., a 9% chromium steel plate.

The photoconductive photoreceptor mainly composed of titanium having photoconductivity is preferably one prepared by dispersing 35 to 65% by volume of rutile titanium dioxide in a binder resin and adding thereto several kinds of regents for the purpose of improving the electrophotographic characteristics, and examples thereof include photoreceptor applied to the invention described in Japanese Patent Publication No. 25438/1963.

Important necessary conditions for the photoreceptor include electrifiability, charge retention in dark, photosensitivity, weather resistance, resistance to discoloration with time, and adhesion to a steel plate. The so-called "coating pretreatment" may be conducted as means for improving the adhesion between the photoreceptor and the metal plate, for example, coat-type chromate treatment, electrolytic chromate treatment, immersion treatment in an oxidizing acid solution, electrolytic treatment in an oxidizing acid solution or the like which has hitherto been regarded as an effective method is effective as the aforesaid coating pretreatment.

The thickness of the electrophotosensitive layer provided on the surface of the metal plate is 5 to 30 μm in terms of the thickness after baking, and the thickness is most preferably 10 to 20 μm in terms of the thickness after baking, because the thickness of the photosensitive layer affects the static charge voltage and photosensitivity, the variation in the thickness of the photosensitive layer in plane is preferably as small as possible because it is causative of mottling.

In order to toner coloring electrophotosensitive layer provided on the surface of the metal plate, it is immersed in a charge-detecting colorant having a charge and dispersed in an organic solvent having a high insulating property, (i.e., the so-called liquid development process; see, e.g., Japanese Patent Publication No. 9416/1983).

In the case of the above-described liquid development process, it is easy to obtain a precise image having superior granularity.

Since toner particles can migrate in an electric field, a developing electrode is opposed to the photoreceptor in order to give rise to an electric field, thereby conducting development.

It is known that the amount of migration of the toner particles and the amount of deposition of the toner particles (color density) depend upon the difference in the electric potential between the developing electrode and the photoreceptor. Therefore, development may be conducted by charging the photosensitive layer in a dark place through corona discharge etc., optionally subjecting the charged photosensitive layer to image exposure to attenuate the electric charge of the exposed portion, thereby forming an electrostatic latent image, and applying to the developing electrode a voltage lower than the electric potential generated by the electrostatic latent image and higher than the residual potential. Alternatively, development may be conducted by applying an electric potential having the same polarity as that of the electric charge of the toner particle to the developing electrode while grounding the photoreceptor.

In the latter case, the control of the voltage applied to the developing electrode enables an arbitrary amount of the toner particles to be deposited on the metal plate, so that it is possible to color the metal plate in a desired color.

In this case, the hue of the toner solution may be the same as the intended hue. Alternatively, it is also possible to reproduce a full-range color through the so-called "three color separation method" wherein colorants for three colors of yellow, magenta and cyan are used, or through the use of colorants for four colors comprising the above colors and black.

As is apparent from Examples which will be described later, in order to obtain a precise image, it is important that the granularity of the colored metal plate thus obtained be 0.3 or less, preferably 0.2.

Furthermore, the electrophotosensitive layer containing 35 to 65% by volume of rutile titanium dioxide dispersed therein is enhanced, whereby the apparent adhesion of the coating can be improved by forming a transparent resin layer or a transparent film layer as an outermost layer through coating, contact bonding or bonding. It is still preferred to use a transparent resin layer and a transparent resin film layer which not only can improve the apparent adhesion of the coating but also have the effects of suppressing the fading of the color pigment and improving the resistance to flawing, and examples of the resin include acrylic resins, urethane resins and fluororesins. Further, the resin may be one which is unreactive with the resin constituting the electrophotosensitive layer and the color pigment and has excellent adhesion of coating. Further, even ultraviolet-curable and electron beam-curable resins may be applied as far as they do not promote the fading of the color pigment.

DETAILED DESCRIPTION OF THE PREFERRED EMBODIMENT

Examples of the present invention will now be described in comparison with Conventional Examples showing the prior art.

EXAMPLES 1 TO 4

(Sample Nos. 1 to 4 and Comparative Examples 1 and 2)

| | |
|---|---|
| titanium dioxide | 27 parts by weight |
| styrene-acrylic copolymer resin | 17 parts by weight |
| sensitizer | 1 part by weight |
| toluene | 56 parts by weight |

The above composition was kneaded and pulverized in a ball mill for 8 hrs to prepare a dispersion. Sample steel plates listed in Table 1 which were different from each other in the center line average height were coated with the dispersion so that the thickness of the coating after drying was 15 μm. The coating was dried at 130° C. for 1 min to prepare a photoconductive photosensitive steel plate.

| | |
|---|---|
| organic pigment | 4 parts by weight |
| acrylic resin | 26 parts by weight |
| charge controlling agent | 0.2 part by weight |
| isoparaffin as solvent | 70 parts by weight |

The above composition was kneaded and pulverized in a paint shaker for 1 hr to prepare a dispersion. 100 parts by weight of the dispersion was added to 1,400 parts by weight of isoparaffin as a solvent for dilution, thereby preparing a toner solution.

Condensed azo (Chromofine ID-5910; a product of Dainichiseika Color and Chemicals Manufacturing Co., Ltd.), quinacridone (Lionogen Magenta R; a product of Toyo Ink Mfg. Co., Ltd.), phthalocyanine (Heliogen Blue 7100; a product of BASF) and carbon black (Raven #3500; a product of Colombian Carbon, Ltd.) were used as organic pigments for yellow, magenta, cyan and black, respectively, for preparation of a toner solution for a full-range color.

The resultant photosensitive steel plates and color toner solution were mounted on a wet developing color copying machine, and the same procedures as those of the ordinary electrophotographic process were repeated. Specifically, after electrification by corona discharge and exposure to light reflected from an original were conducted, development was conducted with a developing device containing a toner solution for cyan, thereby preparing a colored steel plate having a plain color, i.e., cyan.

An image having a color density of 0.7 was prepared by using an original comprising a uniform colored paper which makes clearly discernible the preciseness (granularity) of the image formed on the steel plate.

These images were loaded on an image analyzer (SPICCA; mfd. by Nippon Avionics Co., Ltd.) to measure the granularity (standard deviation value of the color density) of the images. The results for each sample are shown in Table 1, wherein a smaller numerical value indicates a higher preciseness of the image.

When the numerical value exceeds 0.3, the image is harsh to the appearance and poor in the granularity, while when the numerical value is 0.2 or less, the granularity is such that the grain cannot be observed with the naked eye but can be observed when magnified with a magnifier.

A clear difference in the granularity was observed between a center line average height of less than 2.0 μm Ra and one of more than 2.0 μm Ra.

TABLE 1

| | No. | Property of steel plate center line average height (μm Ra) | Property of colored plate granularity |
|---|---|---|---|
| Ex. | 1 | 0.2 | 0.08 |
| | 2 | 0.9 | 0.13 |
| | 3 | 1.4 | 0.16 |
| | 4 | 1.7 | 0.18 |
| Comp. | 1 | 2.3 | 0.33 |
| Ex. | 2 | 3.1 | 0.53 |

EXAMPLE 5

Toner solutions respectively for yellow, magenta and cyan were mounted on the same copying machine as that used in Example 1. An image was formed on the steel plate prepared in the same manner as that of Example 1 (Sample No. 3) and an aluminum plate having a center line average height of 0.2 μm Ra by repeating charging, exposure and development. As a result, a colored steel plate and an aluminum plate each having a pictorial and precise image could be prepared (The color test chart No. 11 produced by the institute of Image Electronics Enginer's of Japan, was used as an original).

EXAMPLE 6

A wet developing color copying machine was remodeled so that a voltage having the same polarity (positive in this case) as that of the particle in the toner solution could be applied to a developing electrode of an image device. The remodeled copying machine was used for development without conducting electrification and exposure. Specifically, after +100 v was applied to a yellow developing electrode to conduct development, +150 v was applied to a magenta developing electrode to conduct development. As a result, a bright color steel plate could be prepared.

EXAMPLE 7

Voltages specified in Table 2 were applied to the developing electrodes respectively for yellow (Y), magenta (M) and cyan (C) of the remodeled copying machine described in the above Example 6 to develop toner particles on steel plates. As a result, steel plates having a desired color tone could be prepared.

TABLE 2

| Applied voltage (V) | | | |
|---|---|---|---|
| Y | M | C | Color tone |
| 100 | 150 | 50 | dark red |
| 80 | 150 | — | bluish red |
| 100 | 100 | — | yellowish red |
| 100 | —. | 180 | green |
| 100 | 30 | 180 | dark green |

EXAMPLES 8 TO 11

The steel plate having a full-range color image and prepared in the above-described Example 5 was coated with an acrylic emulsion resin (LN4523; a product of Nihon Parkerizing Co., Ltd.) to form a 5 μm thick coating, and the coating was baked and dried at 80° C. The fabricability of the steel plate having a full-range color image and coated with a transparent resin on the surface of the developing layer was evaluated by the cupping test.

A polyethylene film having a thickness of 60 μm was stuck as a protective film for the purpose of preventing flawing of the material under test caused by a die, and the maximum drawing height (mm) at which the photosensitive layer was peeled off under conditions of a die diameter of 42 mm, a punch diameter of 40 mm and a blank diameter of 88 mm was evaluated.

Similarly, a 30 μm-thick vinyl chloride film was thermally contact-bonded to the steel plate having a full-range color image and prepared in the abovedescribed Example 5, and the resultant laminate was evaluated in the same manner as that used above. As a result, it was found that, as shown in the following Table 3, the fabricability of the colored steel plates according to the invention of the instant application were superior to that of the steel plate having neither the above-described transparent resin nor transparent film applied or contact-bonded thereto.

TABLE 3

| | No. | Coated protective film | Height of cup drawing (mm) |
|---|---|---|---|
| Ex. | 8 | transparent resin coating | 13 |
| | 9 | transparent resin coating | 15 |
| | 10 | transparent film | 12 |
| | 11 | transparent film | 13 |
| Comp. Ex. 3 | | free | 2 |

It is needless to say that the invention of the instant application is not limited to the above-described Examples only. Further, it is needless to say that the metal plate is not limited to the steel plate only.

Effect of the Invention

As described above, the colored metal plate of the present invention has the effect of copying with the tendencies towards enhanced decorativeness, individualization and higher grade products, and the process for manufacturing a colored metal plate according to the present invention enables the manufacture of a colored metal plate having coloring and appearance which have not been attained in the prior art, and is excellent as a manufacturing process which can realize a production of various kinds of colored plates in a small lot, an enhanced decorativeness and a multi-color superposing, which enables the coloring of a metal plate satisfying the above-described requirements to be conducted on a commercial scale.

Further, it is possible to electrically control the place, site and amount of deposition of a charge-detecting color pigment by taking advantage of the photoconductivity through application of the electrophotographic process, which enables the control of color to be freely conducted, so that a reproduction of coloring of a fine pattern, a photographic image, etc. on a metal plate is attained.

Further, since a production in a small lot is possible, the present invention is effective in that it has a freedom of production.

Further, three or four colors may be selected for the charge-detecting color pigment, which brings about an excellent effect of attaining the reproduction of a full-range color.

In addition to the above-described effects, the present invention is advantageous also in that it is possible to control the shipping of the colored metal plate because a printing plate and surface working of a coating roll are unnecessary and the delivery date of the colored metal plates can be controlled.

What is claim is:

1. A process for manufacturing a colored metal plate, comprising: coating an electrophotosensitive layer composed of electrophotosensitive titanium dioxide and a binder resin on a metal plate having a smooth surface of 2 μm Ra or less in a center line average height; charging the surface of the electrophotosensitive layer to development, and developing the charged surface with a developer or charging the surface of the electrophotosensitive layer, exposing the charged surface and developing the exposed surface with a liquid developer or developing said layer by applying an electric potential having the same polarity as that of a toner particle of a liquid developer to a developing electrode opposed to the surface of the electrophotosensitive layer, to form a toner image having a surface granularity of 0.3 or less.

2. A process for manufacturing a plate according to claim 1, wherein said developer is selected from at least one member selected from the group consisting of cyan developer, magenta developer, yellow developer and black developer.

3. A process for manufacturing a colored metal plate according to claim 2, wherein said development is conducted by a liquid development process.

4. A process for manufacturing a plate according to claim 3, wherein thickness of the electrophotosensitive layer is 5 to 30 μm.

5. A process for manufacturing a plate according to claim 2, wherein thickness of the electrophotosensitive layer is 5 to 30 μm.

6. A process for manufacturing a plate according to claim 1, wherein said development is conducted by the liquid development process.

7. A process for manufacturing a plate according to claim 6, wherein the thickness of the electrophotosensitive layer is 5 to 30 μm.

8. A process for manufacturing a plate according to claim 1, wherein thickness of the electrophotosensitive layer is 5 to 30 μm.

9. A process for manufacturing a colored metal plate according to claim 1, wherein a multicolored image is formed by the use of a developer for a plurality of colors by successively repeating procedures of charging the surface of the electrophotosensitive layer and developing the charged surface with the liquid developer or charging the surface of the electrophotosensitive layer, exposing the charged surface and developing the exposed surface with a developer or developing said layer by applying an electric potential having the same polarity as that of the toner particle of a liquid developer to a developing electrode opposed to the surface of the electrophotosensitive layer.

10. A process for manufacturing a colored metal plate according to claim 9, wherein said developer is at least one member selected from the group consisting of cyan developer, magenta developer, yellow developer and black developer.

11. A process for manufacturing a plate according to claim 10, wherein said development is conducted by a liquid development process.

12. A process for manufacturing a plate according to claim 11, wherein thickness of the electrophotosensitive layer is 5 to 30 μm.

13. A process for manufacturing a plate according to claim 10, wherein thickness of the electrophotosensitive layer is 5 to 30 μm.

14. A process for manufacturing a colored metal plate according to claim 9, wherein said development is conducted by the liquid development process.

15. A process for manufacturing a plate according to claim 14, wherein thickness of the electrophotosensitive layer is 5 to 30 μm.

16. A process for manufacturing a plate according to claim 9, wherein thickness of the electrophotosensitive layer is 5 to 30 μm.

17. A colored metal plate comprising a metal plate having a smooth surface of 2 μm Ra or less in a center line average height, an electrophotosensitive layer coated on Said metal plate composed of electrophotosensitive titanium dioxide and a binder resin and an image composed of toner particles of a liquid developer and formed on the surface of said electrophotosensitive layer, said image having a surface granularity of 0.3 or less.

18. A plate according to claim 17, wherein thickness of the electrophotosensitive layer is 5 to 30 μm.

19. A plate according to claim 18, further comprising a transparent resin coating layer or a transparent resin film layer provided on the surface of the toner layer on the electrophotosensitive layer.

20. A plate according to claim 17, further comprising a transparent resin coating layer or a transparent resin film layer on the surface of the developing layer on the electrophotosensitive layer.

* * * * *